US005172818A

United States Patent [19]

Mautino et al.

[11] Patent Number: 5,172,818

[45] Date of Patent: Dec. 22, 1992

[54] ADJUSTABLE SECURING DEVICE

[75] Inventors: Peter S. Mautino, Verona; Douglas Hanes, Pittsburgh, both of Pa.

[73] Assignee: McConway & Torley Corporation, Pittsburgh, Pa.

[21] Appl. No.: 826,797

[22] Filed: Jan. 28, 1992

[51] Int. Cl.[5] ..... B61G 9/00

[52] U.S. Cl. ..... 213/62 R; 213/75 R

[58] Field of Search ..... 213/67 R, 67 A, 68, 213/69, 70, 71, 72, 75 R, 50, 56, 61, 62 R, 64

[56] References Cited

U.S. PATENT DOCUMENTS

| | | | |
|---|---|---|---|
| 2,452,015 | 10/1948 | Kinne et al. | 213/67 R |
| 3,716,146 | 2/1973 | Altherr | 213/67 R |
| 4,531,648 | 7/1985 | Paton | 213/50 |
| 4,555,033 | 11/1985 | Miller | 213/51 |
| 4,580,686 | 4/1986 | Elliott | 213/62 A |
| 4,700,853 | 10/1987 | Altherr et al. | 213/50 |
| 4,846,358 | 7/1989 | Rhen | 213/64 |
| 5,080,242 | 2/1992 | Steffen et al. | 213/69 |

*Primary Examiner*—Robert J. Oberleitner
*Assistant Examiner*—Kevin D. Rutherford
*Attorney, Agent, or Firm*—James Ray & Associates

[57] ABSTRACT

An adjustable securing device for securing spaced wedge members to provide for movement of the wedges together or apart comprises a threaded bore in one wedge that has threads opposite in direction from a threaded bore in the second wedge. A threaded member has threaded portions engageable with the threaded bores of the wedge members and upon engagement therewith, rotation of the threaded member in one direction moves the wedges apart while rotation in the other direction moves the wedges together. The wedge members preferably have tongues which fit complementary members, such as flanges, on blocks so that engagement of the wedge members with the blocks and movement of the wedges together or apart will either push the blocks apart or pull the blocks together.

21 Claims, 3 Drawing Sheets

ADJUSTABLE SECURING DEVICE

CROSS-REFERENCE TO RELATED APPLICATIONS

This patent application is related to patent application Ser. No. 07/827,149 titled "YOKE FOR COUPLING RAILWAY CARS UTILIZING A DRAWBAR ASSEMBLY" and patent application Ser. No. 07/826,627 titled "AN ADJUSTABLE BLOCKOUT APPARATUS", each of these patent applications were filed concurrently herewith and are assigned to the same assignee.

FIELD OF THE INVENTION

The present invention relates in general, to blockout devices positioned in a draft gear assembly pocket of a yoke used in a slackless drawbar coupling arrangement for connecting adjacent ends of a pair of railway cars together in a substantially semi-permanent manner and, more particularly, this invention relates to an adjustable securing device for use in an axially adjustable blockout device positionable in such draft gear assembly pocket of the yoke.

BACKGROUND OF THE INVENTION

Prior to the introduction of the more powerful and efficient diesel engine in locomotives used in the railroad industry, such railroad locomotives were generally underpowered. It was usually necessary, therefore, to provide each end of a railway freight car with a draft gear assembly, in order for these underpowered locomotives to start a train consist, having several cars, in motion. These draft gear assemblies were used to provide a requisite amount of slack in the coupling arrangement between adjacent ends of several such freight cars making up the train consist. As is generally well known in the railway art, this slack enabled start-up movement of the lead car and thereafter each of the following cars in succession. In other words, during start-up of the train consist the locomotive would begin taking up the slack between it and the lead car first. Then the available slack in each following car, in turn, would be taken up. This start-up procedure enabled the generally lower powered locomotive to gain sufficient initial momentum to start the train consist in motion.

Additionally, in the railway art, it is equally well known that the buff and draft forces which are generated and then applied to the railroad cars in such a coupling arrangement, during in track operation of the train consist, were normally absorbed by these draft gear assemblies. Such draft gear assemblies were mounted in a draft gear pocket located in a yoke disposed within the center sill member of the railway freight car. The railway car coupler mechanism is connected to the yoke by means of a striker plate casting. Nevertheless, these prior art type coupling arrangements resulted in undesirable dynamic loading on both the car body members and their contents. These dynamic loadings usually result in considerable wear of the various components of the coupling mechanism disposed on the freight car and depending upon the contents being transported by such car such dynamic loadings can even result in damage to such contents. It is obvious that wear of the various coupling components will require considerable maintenance to be carried out so that the car can remain in service.

However, since the introduction of the more powerful diesel locomotive, in the modern railroad industry, it has been discovered that the slack, formally required in the older style coupling arrangements, is no longer necessary to start the train consist in motion. In other words, a diesel locomotive provides the capability of starting the movement of a train consist, containing multiple freight cars, without the need for considerable amounts of slack being provided by the draft gear assemblies in the car coupling arrangements. As a result, slackless drawbar assemblies have come into widespread use in the railroad industry as the connecting arrangement for joining together the adjacent ends of a pair of railway cars in a substantially semi-permanent manner. It has been demonstrated that these slackless drawbar assemblies enable the buff and draft forces which are generated by in-track movement to be distributed throughout the car center sill member to all of the railway cars making up such train consist with less damage to both the car components and cargo.

SUMMARY OF THE INVENTION

The present invention provides an adjustable securing device for use in an axially adjustable blockout device. The adjustable blockout device forms a portion of a slackless drawbar assembly which connects the adjacent ends of a pair of railway freight cars together in a substantially semi-permanent fashion. This axially adjustable securing device includes a first wedge shaped member which has both a horizontally disposed top wall portion and a horizontally disposed bottom wall portion. The first wedge shaped member further has a pair of substantially vertically disposed end wall portions and a pair of tapered side wall portions which extend between the top wall portion and the bottom wall portion and between such pair of end wall portions. The top wall portion of such first wedge shaped member has a width which is wider than a width of the bottom wall portion thereof. The adjustable securing device also includes a second wedge shaped member spaced from and confronting such first wedge shaped member. The second wedge shaped member has each of a horizontally disposed top wall portion and a horizontally disposed bottom wall portion. Like the first wedge shaped member, the second wedge shaped member also includes a pair of substantially vertically disposed end wall portions and a pair of tapered side wall portions extending between such top wall portion and such bottom wall portion and between such pair of end wall portions. On the other hand, the top wall portion of the second wedge shaped member has a width which is narrower than a width of such bottom wall portion thereof. There is a first threaded bore provided which extends between and through the top wall portion and the bottom wall portion of the first wedge shaped member. Such first threaded bore has threads oriented in a predetermined one of a left hand and a right hand direction. Additionally, there is a second threaded bore extending between and through such top wall portion and such bottom wall portion of the second wedge shaped member. The second threaded bore is disposed in axial alignment with the first threaded bore. The second threaded bore has threads oriented in an opposite one of such left hand and such right hand direction of such threads in such first threaded bore. The adjustable securing device also includes a threaded member extending into the first threaded bore of such first wedge shaped member and into the second threaded bore of such second wedge shaped member. This threaded member includes a head portion disposed at a first end thereof and a gripping member portion disposed at an axially opposed second end thereof. A shank portion of the threaded member extends between such head portion and such gripping member portion. A first portion of the shank portion, located adjacent the head portion, has a threaded portion engageable with the threads disposed in the first threaded bore in such first wedge shaped member and a second portion of such shank portion, located adjacent said gripping member portion, has a threaded portion engageable with the threads disposed in such second threaded bore in the second wedge shaped member. In this manner, upon threading of the threaded member into the first threaded bore disposed in such first wedge shaped member and such second threaded bore disposed in such second wedge shaped member, the first wedge shaped member and the second wedge shaped member will be secured together. Furthermore, upon rotating the threaded member in a first direction with the first wedge shaped member and the second wedge shaped member being restrained from rotation they will be moved toward one another and upon rotation of the threaded member in an opposite direction they will be moved apart.

OBJECTS OF THE INVENTION

It is therefore, one of the primary objects of the present invention to provide an adjustable securing device for an axially adjustable blockout device disposed in a yoke used in a slackless drawbar coupling arrangement.

Another object of the present invention is to provide an adjustable securing device for an axially adjustable blockout device disposable in a yoke used in a slackless drawbar coupling arrangement which can be easily produced.

Still another object of the present invention is to provide an adjustable securing device for an axially adjustable blockout device disposed in a yoke used in a slackless drawbar coupling arrangement which in combination with the adjustable blockout device can withstand in track forces of more than 1,000,000 pounds being exerted thereon.

Yet another object of the present invention is to provide an adjustable securing device for an axially adjustable blockout device disposed in a yoke used in a slackless drawbar coupling arrangement which can be used with a blockout device that is capable of being adjusted in length as wear occurs in the various components in the coupling arrangement.

A further object of the present invention is to provide an adjustable securing device for an axially adjustable blockout device disposed in a yoke used in a slackless drawbar coupling arrangement which is relatively light weight.

It is an additional object of the present invention to provide an adjustable securing device for an axially adjustable blockout device disposed in a yoke used in a slackless drawbar coupling arrangement which will require a minimum amount of maintenance during the useful life thereof.

Still yet another object of the present invention is to provide an adjustable securing device for an axially adjustable blockout device disposed in a yoke for use in a slackless drawbar coupling arrangement which will permit the yoke and the axially adjustable blockout device to be rather easily and readily removed when maintenance on the yoke, the adjustable blockout device or another car component is required.

It is a further object of the present invention to provide an adjustable securing device for an axially adjustable blockout device disposed a yoke used in a slackless drawbar coupling arrangement which will reduce the wear on the car coupling components.

In addition to the several objects and advantages of the present invention discussed above, various other objects and advantages of the adjustable securing device will become more readily apparent to those persons who are skilled in the railway car coupling art from the following more detailed description of the invention, particularly, when such description is taken in conjunction with the attached drawings and with the appended claims.

BRIEF DESCRIPTION OF THE INVENTION

Figure 1:
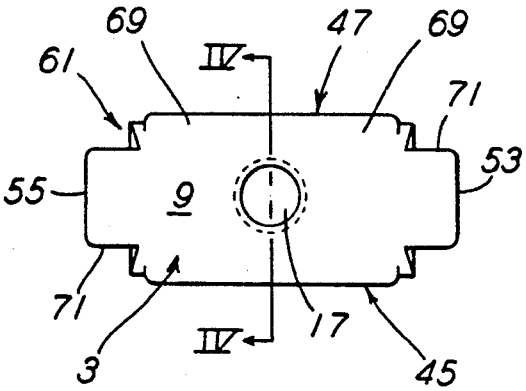
FIG. 1 is a top plan view of the adjustable securing device, according to a presently preferred embodiment of the invention.

Prior to proceeding to a more detailed description of the various embodiments of the present invention it should be noted that, for the sake of clarity, identical components which have identical functions have been identified with identical reference numerals throughout the several views illustrated in the drawings.

Figure 4:
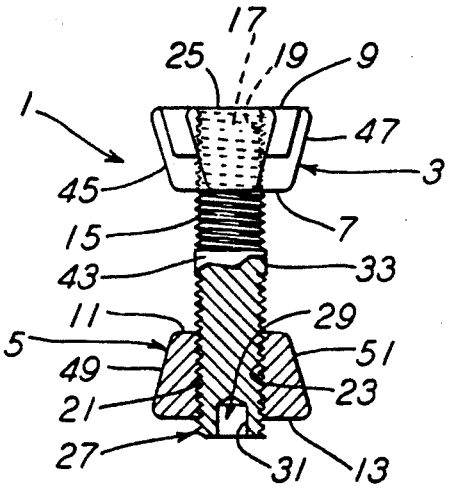
FIG. 4 is an end view of the adjustable securing device with the lower portion in cross-section taken along the lines IV—IV of FIG. 1.
Figure 10:
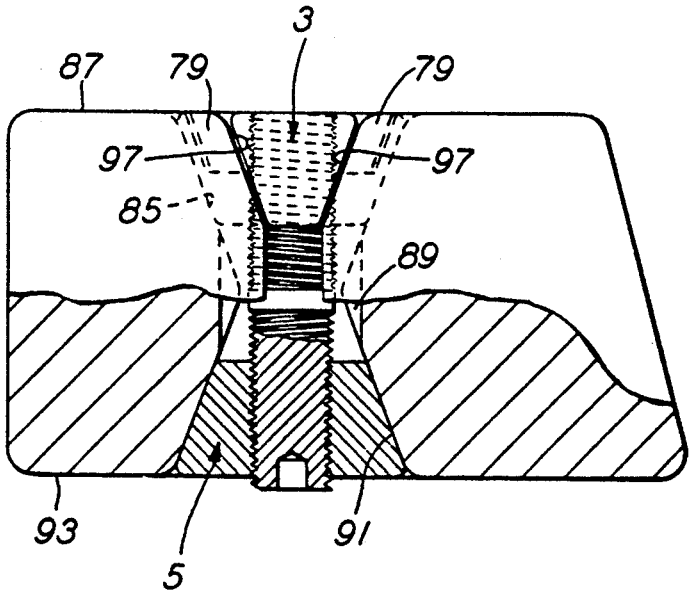
FIG. 10 is an end view of the present invention engaging a pair of spaced blocks with the lower portion shown in cross section taken along the line X—X in FIG. 9.

Now refer more particularly to the drawings. Illustrated therein is an adjustable securing device, generally designated 1. This adjustable securing device secures together a pair of confronting spaced wedge shaped members 3 and 5 (FIG. 4). The first wedge shaped member 3 of such pair of wedge shaped members 3 and 5 has a bottom wall 7 and a top wall 9, while the second wedge shaped member 5 has a top wall 11 and a bottom wall 13. As shown in FIGS. 4 and 10 the spaced wedge shaped members 3 and 5 are secured together in confronting relationship by use of a threaded member 15, with the bottom wall 7 of the first wedge shaped member 3 and the top wall 11 of the second wedge shaped member being spaced from and confronting each other.

Figure 7:
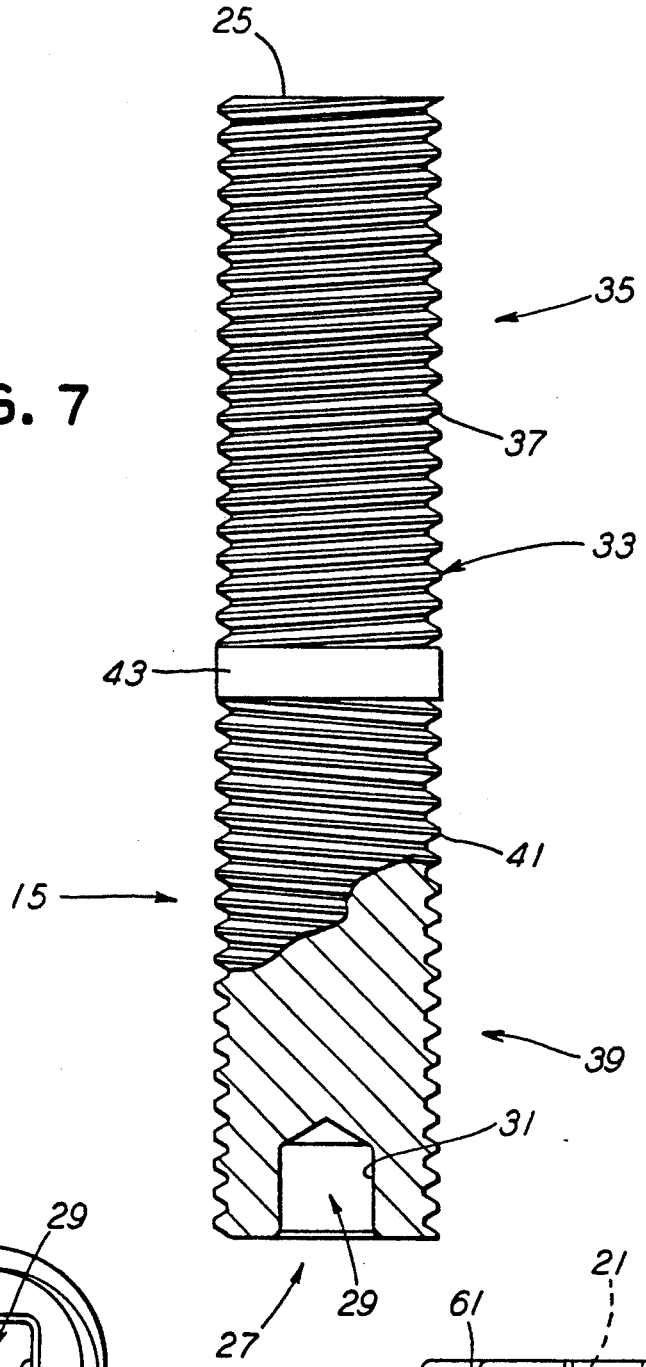
FIG. 7 is an elevational view, partially in cross-section, illustrating a presently preferred embodiment of a threaded member usable in the adjustable securing device of the present invention.
Figure 8:
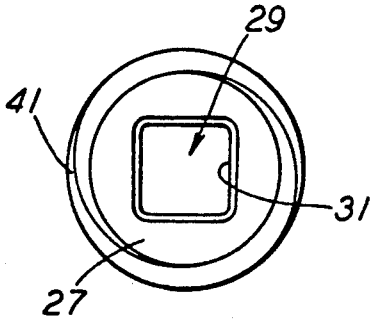
FIG. 8 is an end view of the threaded member of FIG. 7 illustrating a presently preferred gripping member portion of such threaded member.

A first threaded bore 17 is formed through the first wedge shaped member 3 and extends between and through the bottom and top walls 7 and 9, respectively. First threaded bore 17 has threads 19 which are formed in one predetermined direction either left or right handed. A second threaded bore 21 is formed through the second wedge shape member 5 and extends between and through the top and bottom walls 11 and 13, respectively. Such second threaded bore 21 has threads 23 which are formed in the opposite direction of the threads 19 of the first threaded bore 17, either right or left handed threads. The threaded member 15 (FIGS. 7 and 8) has a head portion 25 at one end and a gripping member portion 27 at the opposite end thereof. The gripping member is illustrated in FIGS. 7 and 8 as a recess 29 having a polygonal side wall 31 engageable with a tool for rotation of such threaded member 15. A shank portion 33 extends between the head portion 25 and the gripping member portion 27 of the threaded member 15 with the shank portion 33 having a first threaded portion 35 adjacent the head portion 25, having threads 37 which are engageable with the threads 19 of the first threaded bore 17 of the first wedge shaped member 3, and a second threaded portion 39 adjacent the gripping member portion 27 having threads 41 which ar engageable with the threads 23 of the second threaded bore 21 of the second wedge shaped member 5. Between the first threaded portion 35 and the second threaded portion 39 of the threaded member 15 there is preferably provided an unthreaded section 43.

Wedge shaped member 3 has a pair of end wall portions 45 and 47, at least one of which converges towards the other from said top wall 9 to the bottom wall 7 thereof, with preferably both of such end wall portions 45 and 47 so converging. Second wedge shaped member 5 also has a pair of end wall portions 49 and 51, at least one of which converges towards the other from such bottom wall 13 to such top wall 11, and preferably with both such end wall portions 49 and 51 so converging, as illustrated in FIG. 4. The wedge shaped members 3 and 5 also have side wall portions 53, 55, 57, and 59, respectively.

As can be seen in the drawings, wedge shaped members 3 and 5 are substantially mirror images of each other and have substantially identical corresponding parts except as specified. End wall portions 45 and 47 of wedge shaped member 3 and 49 and 51 of wedge shaped member 5 are substantially shorter than the distance between the side wall portions 53 and 55 and 57 and 59 respectively leaving a recessed flat surface 71 which is preferably parallel to the adjoining one of the end wall portions 45, 47, 49 and 51. The width of side wall portions 53 and 55 and 57 and 59 as defined by flat surfaces 71 is also less than the distance between their respective adjoining end wall portions 45 and 47 and 49 and 51 to permit engagement between engaging means 61 on the wedge shaped members and complementary engaging means 67 on the spaced blocks 63 and 65 as more fully described below.

Figure 2:
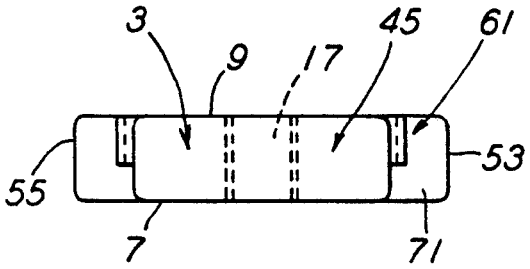
FIG. 2 is a side elevational view of one of the wedge shaped members.
Figure 3:
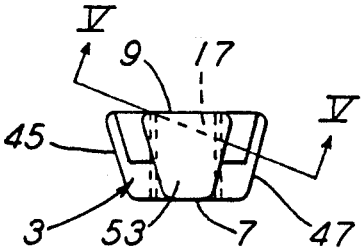
FIG. 3 is an end view of a wedge shaped member taken along line III—III of FIG. 1.
Figure 5:
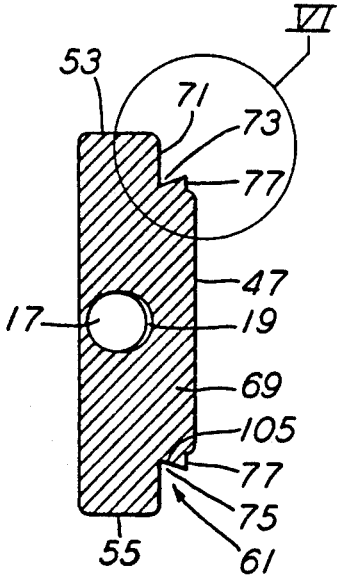
FIG. 5 is a cross-sectional view taken along the lines V—V of FIG. 3.
Figure 6:
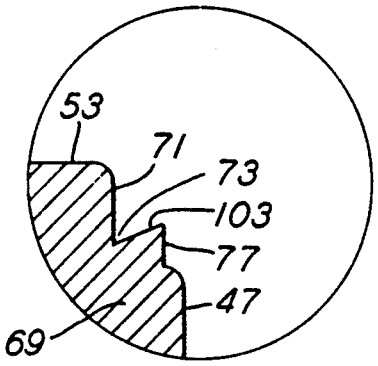
FIG. 6 is a view of a presently preferred dove tail engagement on a wedge shaped member taken from the circle VI of FIG. 5.
Figure 11:
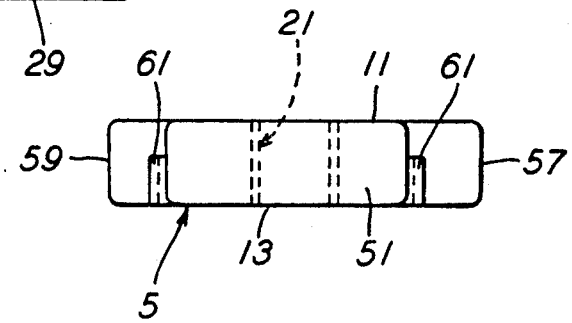
FIG. 11 is a side elevational view of the other of the wedge shaped members shown in FIG. 2.
Figure 9:
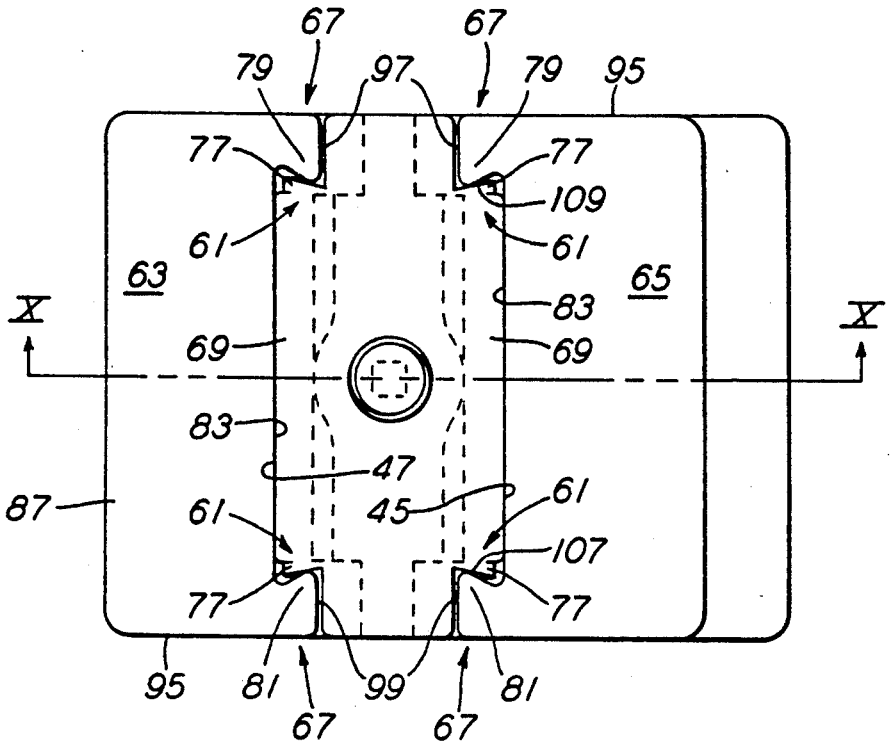
FIG. 9 is a top plan view of the adjustable securing device of the present invention engaging a pair of spaced blocks for axial movement of the spaced blocks towards or away from each other.

Referring to first wedge shaped member 3 (FIG. 5), each end wall portion 45 and 47 preferably has engaging means 61 for engagement with a pair of spaced blocks 63 and 65 or other spaced members and which will engage with complementary engaging means 67 disposed on the blocks 63 and 65 (FIG. 9). These engaging means 61 together with their respective adjacent end wall portions 45, 47, 49 and 51 comprise dovetail tenons. As can best be seen in FIG. 9 the spaced blocks 63 and 65 are formed with complementary dovetail mortises bounded by end faces 85 of the end blocks and the respective undercut faces 107 and 109 of the flanges 79 and 81 respectively. As best seen in FIGS. 1, 5 and 6, the engagement means 61 on the wedge shaped members preferably comprise an outwardly extending undercut tongue or tenon 69 which extends from the respective end wall portions 45, 47, 49 and 51. As seen in FIGS. 5, 6 and 9, the tongues or tenons 69 are undercut at 73 and 75 to provide key members 77 with inwardly slanting walls 103, 105 that interlock with the complementary inwardly slanting walls 107, 109 of the flanges 79, 81 of the spaced end blocks. Key members 77 may extend less than the full depth of end wall portions 45, 47, 49 and 51 as shown in FIGS. 2, 3, and 11 engagement means 67 on spaced blocks 63 and 65 may comprise flanges 79 and 81 (FIGS. 9 and 10).

The spaced blocks 63 and 65 have confronting end faces 83, each confronting end face 83 having a first inclined surface 85 along at least a portion of the end face 83 converging towards a confronting inclined surface 85 from a top wall 87 of the block towards an intermediate section 89 of the end face 83, and a second inclined surface 91 along at least a portion of the end face 83 converging towards a confronting end face 83 from a bottom wall 93 towards the intermediate section 89 of the end face 83. The flanges 79 and 81 are provided on each of the inclined surfaces 83 and 89 of the end faces 81 of the blocks 63 and 65, which flanges 79 and 81 are adjacent side walls 95 of the spaced blocks 63 and 65 and extend outwardly from the confronting end faces 83, with the outer surfaces 97 and 99 of the flanges 79 and 81 being parallel to the inclined surfaces 85 and 91, respectively, of the end faces 83.

As can best be seen in FIG. 6, surfaces 103, 105 of each of the key members 77 may be recessed from the surface of the end wall portions 45, 47, 49 and 51 and the resulting outside corners of such key members and end wall portions may be rounded as shown to help avoid sticking or binding of wedge shaped members 3 and 5 as they move within the flanges 79, 81 of the spaced blocks 63 and 65 in response to rotation of threaded member 15. This also ensures that forces applied to the device in service are applied directly to the wedge shaped members by contact between the relatively broad surfaces 45, 47, 49 and 51 and adjacent complementary surfaces of the spaced blocks rather than being applied to the relatively narrow and fragile key members.

In assembling of the adjustable securing device 1, the first wedge shaped member 3 is threaded onto the first threaded portion 35 of the threaded member 15 and the second wedge shaped member 5 is threaded onto the second threaded portion 39 of the threaded member 15. With the wedge shaped member 3 and 5 restrained from turning, the rotation of the threaded member 15 in one direction will cause the wedge shaped members 3 and 5 to be moved closer to each other, while rotation of the threaded member 15 in the opposite direction will cause the wedge shaped members 3 and 5 to be moved further away from each other thereby adjusting the axial length of the axially adjustable blockout device.

When the wedge shaped members 3 and 5 are engaged with the spaced blocks 63 and 65, such as by use of the tongue 69 with key members 77, and flanges 79 and 81 on the spaced blocks 63 and 65, rotation of the threaded member 15 to move the wedge shaped members 3 and 5 together will also move spaced blocks 63 and 65 away from each other, while rotation of the threaded member 15 to move the wedge shaped members 3 and 5 apart will move spaced blocks 63 and 65 closer to each other.

While a presently preferred and a number of alternative embodiments of the present invention have been described in detail above it should be obvious that those persons who are skilled in the railway art can make various other modifications and adaptations to this invention without departing from the spirit and scope of the appended claims.

We claim:

1. An adjustable securing device for an axially adjustable blockout device that forms a portion of a slackless drawbar assembly which connects adjacent ends of a pair of railway car together in a substantially semi-permanent fashion, said adjustable securing device comprising:

(a) a first wedge shaped member having each of a horizontally disposed top wall portion and a horizontally disposed bottom wall portion, a pair of substantially vertically disposed end wall portions and a pair of tapered side wall portions extending between said top wall portion and said bottom wall portion and between said pair of said end wall portions, said top wall portion having a predetermined width which is wider than a predetermined width of said bottom wall portion;

(b) a second wedge shaped member spaced from and confronting said first wedge shaped member, said second wedge shaped member having each of a horizontally disposed top wall portion and a horizontally disposed bottom wall portion, a pair of substantially vertically disposed end wall portions and a pair of tapered side wall portions extending between said top wall portion and said bottom wall portion and between said pair of said end wall portions, said top wall portion having a predetermined width which is narrower than a width of said bottom wall portion;

(c) a first threaded bore extending between and through said top wall portion and said bottom wall portion of said first wedge shaped member, said first threaded bore having threads oriented in one of a left hand and a right hand predetermined direction;

(d) a second threaded bore extending between and through said top wall portion and said bottom wall portion of said second wedge shaped member and disposed in axial alignment with said first threaded bore, said second threaded bore having threads oriented in an opposite one of said left hand and said right hand predetermined direction of said thread in said first threaded bore; and (e) a threaded member extending into said first threaded bore of said first wedge shaped member and into said second threaded bore of said second wedge shaped member, said threaded member including, (i) a head portion disposed at a first end thereof, (ii) a gripping member portion disposed at an axially opposed second end thereof, and (iii) a shank portion extending between said head portion and said gripping member portion, a first portion of said shank portion located adjacent said head portion, having a threaded portion engageable with said threads disposed in said first threaded bore in said first wedge shaped member and a second portion of said shank portion, located adjacent said gripping member portion, having a threaded portion engageable with said threads disposed in said second threaded bore in said second wedge shaped member so that upon threading of said threaded member into first threaded bore in said first wedge shaped member and said second threaded bore in said second wedge shaped member, said first wedge shaped member and said second wedge shaped member will be secured together and upon rotating said threaded member in a first direction with said first wedge shaped member and said second wedge shaped member being restrained from rotation they will be moved toward one another and upon rotation of said threaded member in an opposite direction they will be moved apart.

2. An adjustable securing device, according to claim 1, wherein at least one of said pair of said end wall portions of said first wedge shaped member converges from said top wall portion towards said bottom wall portion.

3. An adjustable securing device, according to claim 1, wherein at least one of said pair of said end wall portions of said second wedge shaped member converges from said bottom wall portion towards said top wall portion.

4. An adjustable securing device, according to claim 2, wherein each of said pair of said end wall portions of said first wedge shaped member converges from said top wall portion towards said bottom wall portion.

5. An adjustable securing device, according to claim 3, wherein each of said pair of said end wall portions of said second wedge shaped member converges from said bottom wall portion towards said top wall portion.

6. An adjustable securing device, according to claim 1, wherein said gripping member portion of said threaded member includes a recess, having a predetermined configuration, formed therein adjacent an end surface thereof.

7. An adjustable securing device, according to claim 6, wherein said predetermined configuration of said recess formed in said gripping member portion of said threaded member has a polygonal sidewall.

8. An adjustable securing device, according to claim 1, wherein said threaded member includes an untreated portion disposed intermediate said head portion and said gripping member portion.

9. An adjustable securing device, according to claim 1, wherein said first wedge shaped member includes at least one engagement means disposed thereon for engaging a complementary engagement means disposed on a block portion of such adjustable blockout device.

10. An adjustable securing device, according to claim 9, wherein said at least one engagement means disposed on said first wedge shaped member includes at least one tongue disposed on each of said pair of said end wall portions.

11. An adjustable securing device, according to claim 10, wherein said at least one engagement means disposed on said first wedge shaped member further includes a key member disposed on and extending outwardly from an edge of said at least one tongue.

12. An adjustable securing device, according to claim 1, wherein said second wedge shaped member includes at least one engagement means disposed thereon for engaging a complementary engagement means disposed on a block portion of such adjustable blockout device.

13. An adjustable securing device, according to claim 12, wherein said at least one engagement means disposed on said second wedge shaped member includes at least one tongue disposed on each of said pair of said end wall portions.

14. An adjustable securing device, according to claim 13, wherein said at least one engagement means disposed on said second wedge shaped member further includes a key member disposed on and extending outwardly from an edge of said at least one tongue.

15. An adjustable securing device for an adjustable blockout device forming a portion of a slackless drawbar assembly which connects adjacent ends of a pair of railway cars together in a substantially semi-permanent fashion, said adjustable securing device comprising:

(a) a first wedge shaped member having each of a horizontally disposed top wall portion, a horizontally disposed bottom wall portion, a pair of substantially vertically disposed end wall portions in which vertically oriented outer edges thereof converge towards each other from said top wall portion to said bottom wall portion and a pair of tapered side wall portions extending between said top wall portion and said bottom wall portion and between said pair of said end wall portions;

(b) a second wedge shaped member spaced from and confronting said first wedge shaped member, said second wedge shaped member having each of a horizontally disposed top wall portion and a horizontally disposed bottom wall portion, a pair of substantially vertically disposed end wall portions in which vertically oriented outer edges thereof converge towards each other from said bottom wall portion to said top wall portion and a pair of tapered side wall portions extending between said top wall portion and said bottom wall portion and between said pair of said end wall portions;

(c) a first threaded bore extending between and through said top wall portion and said bottom wall portion of said first wedge shaped member, said first threaded bore having threads oriented in one of a left hand and a right hand predetermined direction;

(d) a second threaded bore extending between and through said top wall portion and said bottom wall portion of said second wedge shaped member, and disposed in axial alignment with said first threaded bore, said second threaded bore having threads oriented in an opposite one of said left hand and said right hand predetermined direction of said threads in said first bore; and (e) a threaded member extending into said first threaded bore of said first wedge shaped member and into said second threaded bore of said second wedge shaped member, said threaded member including, (i) a head portion disposed at a first end thereof, (ii) a gripping member portion disposed at an axially opposed second end thereof, and (iii) a shank portion extending between said head portion and said gripping member portion, a first portion of said shank portion, located adjacent said head portion, having a threaded portion engageable with said threads disposed in said first threaded bore in said first wedge shaped member and a second portion of said shank portion, located adjacent said gripping member portion, having a threaded portion engageable with said threads disposed in said second threaded bore in said second wedge shaped member so that upon threading of said threaded member into said first threaded bore in said first wedge shaped member and into said second threaded bore in said second wedge shaped member, said first wedge shaped member and said second wedge shaped member will be secured together and upon rotating said threaded member in a first direction with said first wedge shaped member and said second wedge shaped member being restrained from rotation they will be moved toward one another and upon rotation of said threaded member in an opposite direction they will be moved apart.

16. An adjustable securing device, according to claim 15, wherein said first wedge shaped member includes at least one engagement means disposed thereon for engaging a complementary engagement means disposed on a block portion of such adjustable blockout device.

17. An adjustable securing device, according to claim 16, wherein said at least one engagement means disposed on said first wedge shaped member includes at least one tongue disposed on each of said pair of said end wall portions.

18. An adjustable securing device, according to claim 17, wherein said at least one engagement means disposed on said first wedge shaped member further includes a key member disposed on and extending outwardly from an edge of said at least one tongue.

19. An adjustable securing device, according to claim 15, wherein said second wedge shaped member includes at least one engagement means disposed thereon for engaging a complementary engagement means disposed on a block portion of such adjustable blockout device.

20. An adjustable securing device, according to claim 19, wherein said at least one engagement means disposed on said second wedge shaped member includes at least one tongue disposed on each of said pair of said end wall portions.

21. An adjustable securing device, according to claim 20, wherein said at least one engagement means disposed on said second wedge shaped member further includes a key member disposed on and extending outwardly from an edge of said at least one tongue.

* * * * *

UNITED STATES PATENT AND TRADEMARK OFFICE

CERTIFICATE OF CORRECTION

PATENT NO. :5,172,818

DATED :December 22, 1992

INVENTOR(S) :Peter Scott Mautino et al.

It is certified that error appears in the above-identified patent and that said Letters Patent is hereby corrected as shown below:

Column 5, line 30, delete "ar" and insert --are--.

Signed and Sealed this

Twenty-sixth Day of October, 1993

*Attest:*

Bruce Lehman

BRUCE LEHMAN

*Attesting Officer*

*Commissioner of Patents and Trademarks*